US006869504B2

(12) United States Patent
Hietaniemi

(10) Patent No.: US 6,869,504 B2
(45) Date of Patent: Mar. 22, 2005

(54) APPARATUS FOR PASSING STOCK INTO A HEADBOX OF A PAPER MACHINE OR EQUIVALENT

(75) Inventor: Matti Hietaniemi, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/465,978

(22) PCT Filed: Dec. 19, 2001

(86) PCT No.: PCT/FI01/01129

§ 371 (c)(1),
(2), (4) Date: Oct. 14, 2003

(87) PCT Pub. No.: WO02/057542

PCT Pub. Date: Jul. 25, 2002

(65) Prior Publication Data

US 2004/0060680 A1 Apr. 1, 2004

(30) Foreign Application Priority Data

Dec. 29, 2000 (FI) ..... 20002896

(51) Int. Cl.[7] ..... D21F 1/66

(52) U.S. Cl. ..... 162/190; 162/264; 162/336; 162/380; 95/266; 95/241; 95/24; 95/19

(58) Field of Search ..... 162/190, 264, 162/336, 380, 202; 95/266, 241, 24, 19

(56) References Cited

U.S. PATENT DOCUMENTS 4,219,340 A * 8/1980 Kaiser ..... 95/266
4,443,232 A * 4/1984 Kaiser ..... 95/24

FOREIGN PATENT DOCUMENTS

WO WO 02/057542 A1 7/2002

OTHER PUBLICATIONS

International Preliminary Examination Authority issued in PCT/FI01/01129.
International Search Report issued in International App. No. PCT/FI01/01129.

* cited by examiner

*Primary Examiner*—Mark Halpern
(74) *Attorney, Agent, or Firm*—Stiennon & Stiennon

(57) ABSTRACT

A vacuum pump ($P_0$) provides vacuum to a paper machine deaeration tank (11) which has an inlet duct (10) through which the tank is supplied with wire water. A discharge duct (12) extends from the deaeration tank (11). There is an overflow (14) for the wire water in the discharge duct at the discharge end of the discharge duct (12). The overflow (14) of the discharge duct (12) is located below the deaeration tank (11) and opens to a free air space. The discharge duct (12) includes a branch duct (15$a_1$) for a flow which is passed to the headbox (100).

23 Claims, 3 Drawing Sheets

APPARATUS FOR PASSING STOCK INTO A HEADBOX OF A PAPER MACHINE OR EQUIVALENT

CROSS REFERENCES TO RELATED APPLICATIONS

This application is a national stage application of International Application No. PCT/F101/01129 and claims priority on Finnish Application No. 20002896, filed Dec. 29, 2000, the disclosure of which is incorporated by reference herein.

STATEMENTS AS TO RIGHTS TO INVENTIONS MADE UNDER FEDERALLY SPONSORED RESEARCH AND DEVELOPMENT

Not applicable.

BACKGROUND OF THE INVENTION

The invention relates to an apparatus for passing stock to a headbox of a paper machine or equivalent.

SUMMARY OF THE INVENTION

When a deaeration tank is situated between centrifugal cleaning and a headbox feed pump in the short circulation, it should act not only as a means of removing air but also as a pressure equalizer before the headbox feed pump. However, the deaeration tank does not guarantee a constant pressure since, in the pressure conditions of the deaeration tank, air bubbles take a large part of its liquid volume. For example, 5% of air takes 50% of the liquid volume at a pressure of 0.1 atm. The foaming of air bubbles in the deaeration tank is unstable. The overflow from the deaeration tank evens out the surface but it pays no attention to whether there is air or gas in the liquid space of the deaeration tank. For this reason, the pressure after the deaeration tank varies. The pressure variations are transmitted to the headbox. The pressure control of the headbox attempts to maintain a uniform pressure in the approach pipe, but it affects the level of the surface in the deaeration tank, intensifying the disturbance. Mere removal of the overflow from the deaeration tank is not enough because the pressure variation turns into consistency variation.

In accordance with the invention, the deaeration tank can be accomplished without an overflow if it is in hydraulic connection with an overflow surface in the cellar. For example, the lock water part in a circulation water tank can act as an overflow surface if the deaeration tank is arranged to treat wire water in the short circulation. It is advisable to build the overflow so that it is wide. When short circulation dilutions, among other things, for the headbox feed and fan pumps are taken from a connecting pipe, the pressure of the short circulation remains constant, because it is determined by a stable overflow at normal pressure, in which there is no problem caused by bubbling of air. In controlling the vacuum in the deaeration tank, turbo blowers may be more suitable than vacuum pumps. The process is simpler than before, consumes less energy and requires a considerably smaller process volume. When the flow of wire water increases, the speeds in the cyclone and in the spray tubes of the deaeration tank increase, which increases deaeration capacity.

Thus, in accordance with the invention, the deaeration tank is provided with an overflow which is disposed at the distance of the static height difference of the liquid column required by vacuum from the deaeration tank, for example, in the cellar space in the paper machine hall. The height difference between the liquid surface of the deaeration tank and the overflow surface is advantageously in a range 5 to 10 m.

The back-pressure required by the pump is about 3–4 m counted as a static water column depending on the pump. The level of the overflow surface need not be controlled, i.e. it may be fixed, so that it is about 8 m below the surface of the liquid in the deaeration tank (8 m corresponds to a vacuum of 80 kPa in the deaeration tank). In that connection, it must be possible to adjust the vacuum level in the deaeration tank. The deaeration tank would then be located about 13 m above the cellar level, i.e. about 4 m above the machine level. The pressure loss in the spray feeding of the deaeration tank is about 3–5 m. When the pressure loss of the deaeration tank is added to the back-pressure of the pump, a level slightly lower than the machine level is achieved, which means that the waters coming from the wire can be treated with the system in question without additional pumping. The diameter of the distributor pipe is in a range of 0.3 to 2.0 m and the time in which the liquid flows from the deaeration tank to the biggest site of use is less than 2 minutes, in practice about 5 seconds. Thus, the invention employs a deaeration tank which has no overflow, while, in accordance with the invention, the discharge duct of the deaeration tank comprises an overflow. The overflow is preferably disposed in a wire water tank or equivalent. In accordance with the invention, a branch duct/branch ducts is/are arranged to lead from the duct between the overflow of said discharge duct and the deaeration tank to a headbox, preferably to the suction side of a headbox feed pump.

The apparatus according to the invention provides a stock flow, which is uniform both in pressure and in consistency, to the suction side of the headbox feed pump and further to the headbox.

The paper machine or equivalent is understood to mean printing paper, board, and soft tissue machines.

In the following, the invention will be described with reference to some advantageous embodiments of the invention illustrated in the figures of the appended drawings, to which the invention is, however, not meant to be exclusively confined.

DESCRIPTION OF THE PREFERRED EMBODIMENTS

Figure 1A:
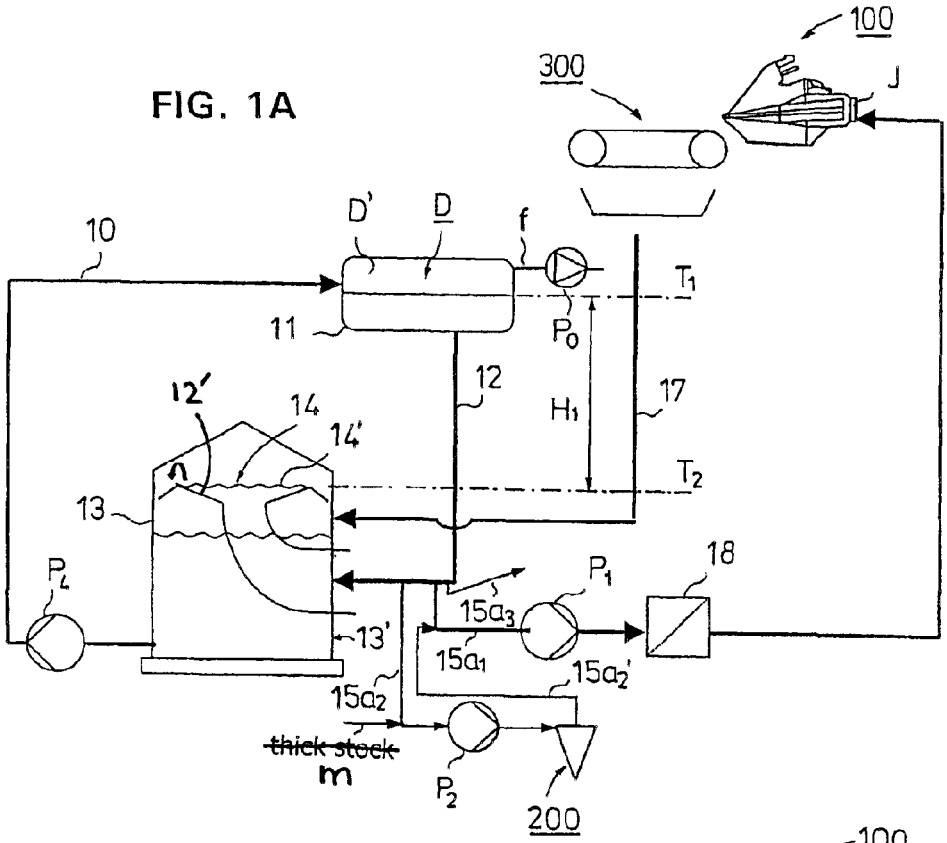
FIG. 1A shows a first advantageous embodiment of the invention. In the embodiment of the figure, a discharge duct of a deaeration tank is arranged to lead into connection with a tank such that the end of the discharge duct opens centrally in the tank and forms an overflow.

FIG. 1A shows a first advantageous embodiment of the invention which relates to a stock feed system of a headbox in a paper machine or equivalent and to its short circulation. Wire water is passed along a duct 10 into a deaeration tank 11, which has a discharge duct 12 for wire water from which air has been removed, and which discharge duct 12 comprises at its end an overflow 14, in which connection the height difference $H_1$ between the level $T_2$ of the overflow surface 14' of said overflow and the surface $T_1$ of the wire water in the deaeration tank 11 is in a range of 5 to 10 m. The deaeration tank 11 comprises for wire water an inside tank space D, which comprises a vacuum space D' above the liquid, into which space vacuum is drawn through a duct f by means of a vacuum pump $P_0$, an exhaust pump or another device and, at the same time, air is removed from the wire water. By the wire water is meant water that is removed from a paper web on the paper machine.

As shown in FIG. 1A, the discharge duct 12 is arranged to lead into connection with a tank 13 through its wall and upwards in the tank. The discharge duct comprises the overflow 14 which is located centrally in the tank for example, in a wire water tank 13. Branch ducts 15$a_3$, 15$a_2$, 15$a_1$ open into the discharge duct 12 of the deaeration tank, wire water and thick stock m being passed through the duct 15$a_2$ of said ducts first to the suction side of a feed pump $P_2$ and further to a centrifugal cleaning plant 200, from which the stock mixture is passed through a duct 15$a_2$' to a mixing point of the wire water passed from the branch duct 15$a_1$ of the discharge duct 12, at which mixing point the stock mixture is diluted to a headbox consistency and passed to the suction side of a headbox feed pump $P_1$ and further to an inlet header J of a headbox 100. Dilution water is passed through the branch duct 15$a_3$ to the thickness profiling system of the headbox of the paper machine. Advantageously, the connection points of the branch ducts are located in the discharge duct 12 close to the overflow 14 and, in the height direction, below the overflow 14.

The discharge duct 12 can thus in itself comprise an overflow 14, i.e. the lower end 12' of the discharge duct 12 is placed, as shown in FIG. 1A, centrally inside the wire water tank 13 and said end opens upwards to normal atmospheric pressure in the tank 13, in which connection a constant pressure prevails in the discharge duct 12. The end result, then, is the same as in the preceding case, i.e. a constant pressure prevails in the discharge duct 12. Wire water/stock is passed by means of a pump $P_4$ to the deaeration tank 11. Wire water is passed through a duct 17 of the tank 13.

Figure 1B:
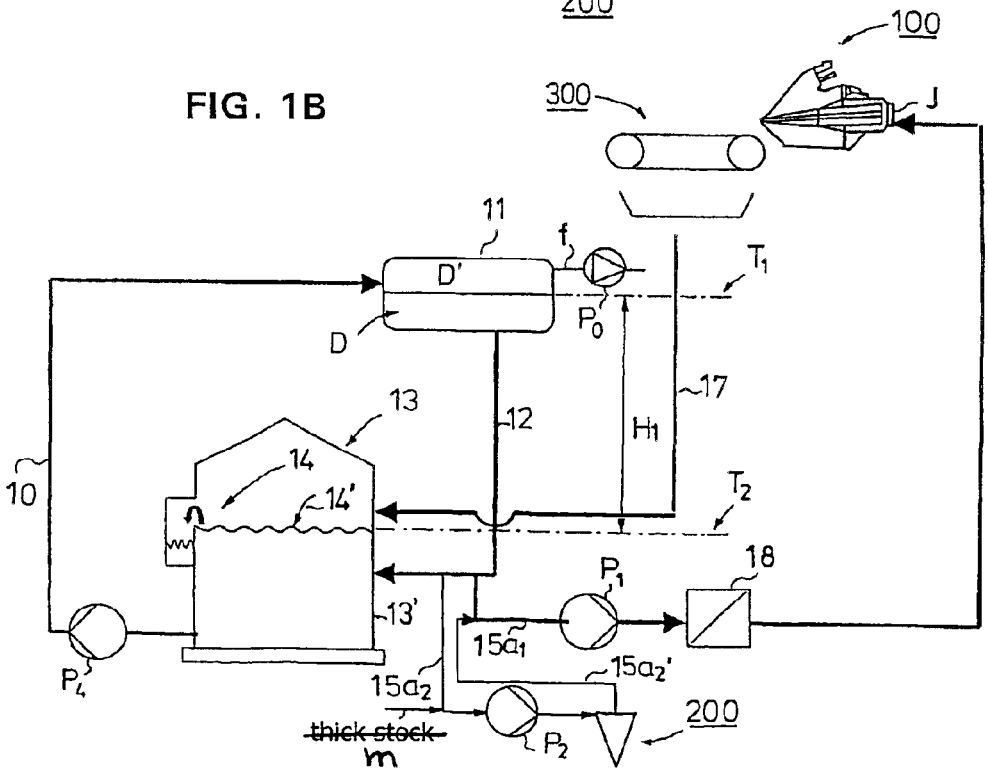
FIG. 1B shows an embodiment of the invention comprising a discharge duct which is connected directly to a tank which comprises an overflow.

FIG. 1B shows an embodiment in which a discharge duct 12 of a deaeration tank is connected to the tank 13 itself, which comprises an overflow 14. The overflow 14 is formed such that the discharge duct 12 opens into the tank 13 from its side surface 13', in which case the tank 13 itself comprises the overflow 14 in its connection. The height difference between the overflow 14 and the surface level $T_1$ of the stock in the deaeration tank is designated by $H_1$ in the figure. $H_1$ is in a range of 5 to 10 m.

Figure 1C:
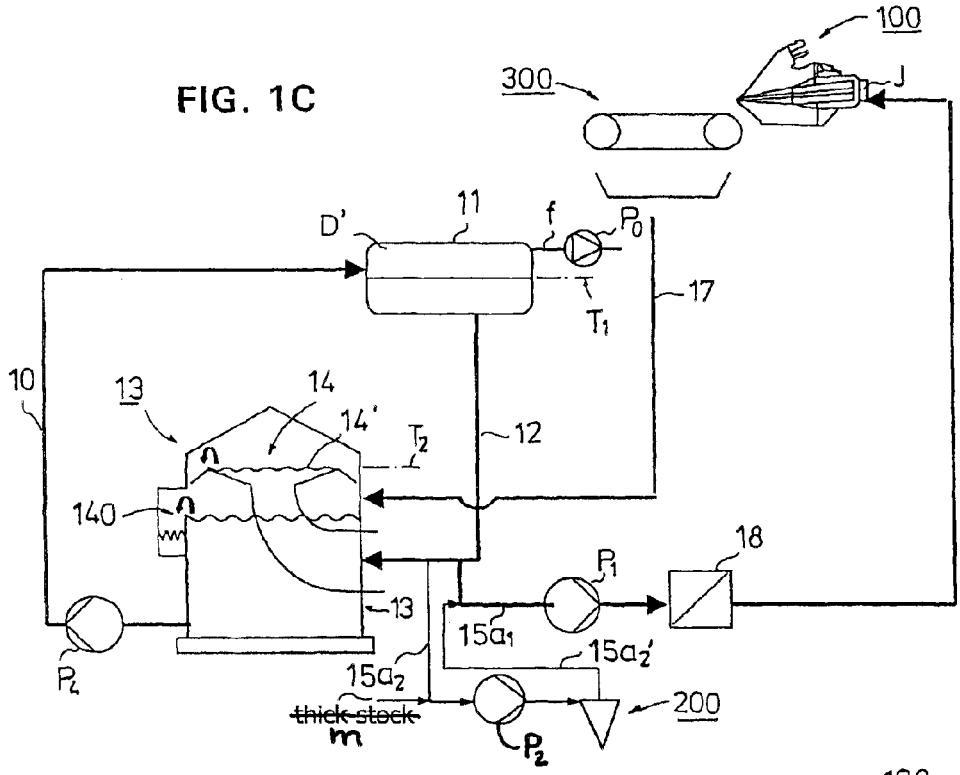
FIG. 1C shows an embodiment of the invention including a tank which comprises two overflows, i.e. an overflow for a discharge duct and, in addition, an overflow for the surface level of the stock in the tank.

FIG. 1C shows an embodiment in which a tank 13 comprises two overflows, i.e. an overflow 14 of a discharge duct 12 and, in addition, an overflow 140 which regulates the surface level of the stock in the tank 13 and, thus, the pressure prevailing in the tank. Wire water is circulated from the tank 13 by means of a pump $P_4$ along a duct 10 to a deaeration tank 11, and wire water from which air has been removed is passed along the discharge duct 12 into the tank 13. The discharge duct 12 of the deaeration tank 11 is provided with a branch duct 15$a$, for a headbox feed pump $P_1$ which stock is passed further to an inlet header J of a headbox 100, and with a branch duct 15$a_2$ for a feed Pump $P_2$, from which stock is passed to a centrifugal cleaning plant 200 and further to the headbox 100 through a passage to the branch duct 15$a_1$.

Figure 1D:
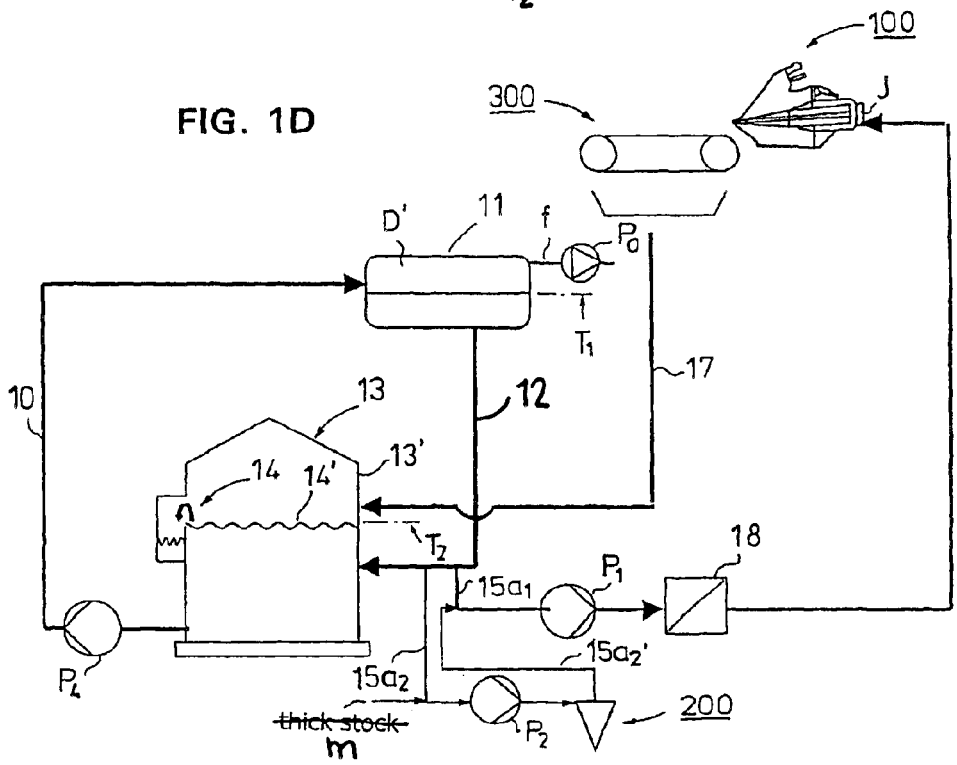
FIG. 1D shows an additional embodiment of the invention.

FIG. 1D shows an embodiment of the invention in which an overflow 14 of a duct 12 is formed such that the discharge duct 12 opens into a tank 13 from its side surface. The tank 13 comprises the overflow 14 for the liquid surface. Wire water from which air has been removed is passed through the discharge duct 12 to the tank 13. Wire water is pumped by means of a pump $P_4$ along a duct 10 into a deaeration tank 11, which is located in an elevated position with respect to the tank 13. The discharge duct 12 comprises, in the vicinity of the overflow 14 but at a lower level, branch ducts 15$a_1$, 15$a_2$, which comprise pumps $P_1$, $P_2$, in which connection stock is passed through the branch duct 15$a_1$ to a headbox and through the branch duct 15$a_2$ to a centrifugal cleaning plant 200 and further to the branch duct 15$a_1$. Virgin stock m is added to the branch duct 15$a_2$. Wire water is passed to the upper part of the tank 13 through a duct 17.

Figure 1E:
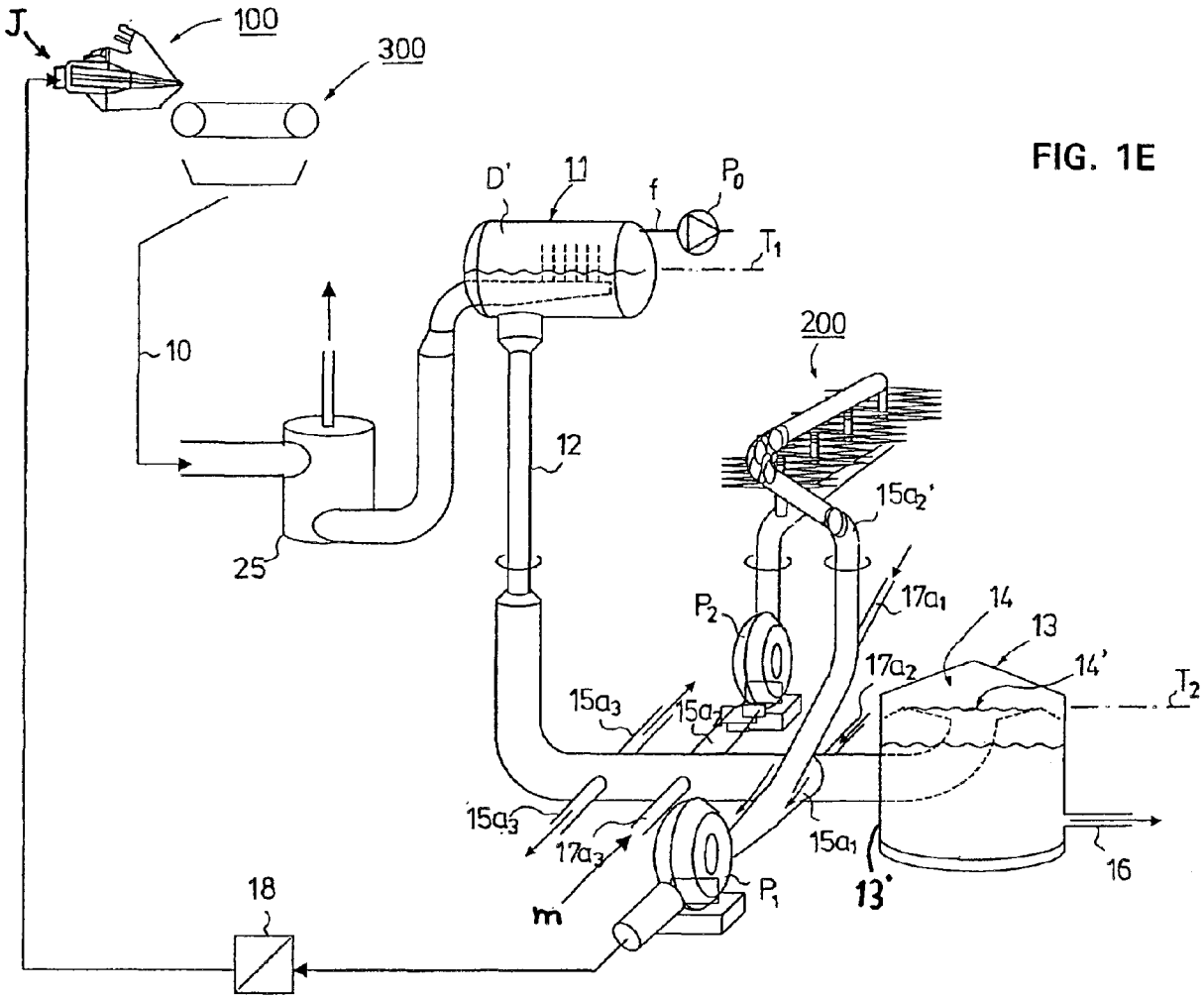
FIG. 1E is an axonometric illustration of the short circulation of stock in accordance with the invention in connection with a headbox of a paper machine, as well as of a centrifugal cleaning plant.

FIG. 1E shows an embodiment of the invention in which the wire water removed from a wire section 300 of a paper machine or equivalent is passed along a duct 10 into a cyclone 25 and further into a deaeration tank 11. The purpose of the cyclone 25 is to remove air from wire water already before the deaeration tank 11 proper. The deaeration tank 11 having no overflow comprises a discharge duct 12 for air-free wire water, which discharge duct 12 ends in an overflow 14 at a lower level in a tank 13 in accordance with the invention. As axonometrically shown in the figure, the end of the discharge duct 12 is arranged to lead through a side wall 13' of the tank 13, and the end of the discharge duct 12 opens to a free air space and a normal air pressure inside the tank 13. Thus, in the duct 12, a constant pressure prevails in the air-free wire water. As illustrated in the figure, tubes 15$a_3$ or ducts open from the branch duct 12 in a lower position in the vertical plane with respect to the overflow 14, through which tubes or ducts dilution water is passed, for example, to serve as headbox dilution water or as stock dilution water. In addition, as illustrated in the figure, thick stock m is passed through a duct 17$a_3$ to the discharge duct 12 and, through a branch duct 15$a_2$ situated on the opposite side, a mixture of wire water and thick stock m is passed from the duct 12 to the discharge duct 15$a_2$ and further to a feed pump $P_2$, which feeds stock to a centrifugal cleaning plant 200. The mixture of wire water and stock is passed from the centrifugal cleaning plant 200 to a branch duct 15$a_2$', which is connected with a branch duct 15$a_1$ branching from the discharge duct 12. The combined flow of stock and wire water is passed along the duct 15$a$, to the suction side of a headbox feed pump $P_1$ and further through a machine screen 18 to a stock inlet header J of a headbox 100 of the paper machine. Additives/fillers or dilution liquid can be added through ducts 17$a_1$ and 17$a_2$ to the stock to be fed to the headbox. A duct 16 opens from the lower part of the tank 13 for passing wire water to the long circulation.

A duct f leads to the deaeration tank 11 from a vacuum pump $P_0$ or equivalent, by means of which vacuum is drawn into the interior space of the tank 11 and air released from wire water is removed from the tank space D'. In the deaeration tank air is removed only from wire water. After that, the wire water is used at different locations, among other things, for dilution of stock. A cyclone-shaped device 25 is used before the deaeration tank, a centrifugal field being produced in said device to separate air in the form of bubbles, and there may be several cyclone-shaped devices 25 for different water fractions of the wire section. A flow duct is also used before the deaeration tank, the flow containing more air being separated from the upper part of said flow duct.

What is claimed is:

1. An apparatus for passing stock to a headbox of a paper machine, comprising:

a deaeration tank, the deaeration tank when filled with wire water having a defined wire water surface within the deaeration tank;

a vacuum pump connected to the deaeration tank to pull a vacuum on the deaeration tank;

an inlet duct connected to the deaeration tank and to at least one source of wire water, so that wire water can flow from the at least one source of wire water to the deaeration tank;

a discharge duct connected to the deaeration tank, the discharge duct having a discharge end, the discharge end having an overflow, the overflow defining an overflow surface, said overflow of the discharge duct and the overflow surface defined thereby being located below the defined wire water surface within the deaeration tank and opening to a free air space; and wherein the discharge duct includes a first branch duct extending from the discharge duct and in communication with the headbox.

2. The apparatus of claim 1 wherein the end of the discharge duct forms the overflow.

3. The apparatus of claim 2 wherein the discharge duct leads first downwards and then as the discharge duct approaches the discharge end upwards in the vertical direction, so that the discharge duct opens upwards to a free air space and to a normal air pressure.

4. The apparatus of claim 3 wherein the discharge duct leads through a wall of a stock and/or wire water second tank and the discharge duct opens upwards inside the second tank and wherein the second tank has an opening to normal air pressure.

5. The apparatus of claim 4 wherein the overflow surface for wire water flowing through the discharge duct end of the discharge duct opens in the second tank in a space above a liquid surface in the second tank.

6. The apparatus of claim 1 wherein the end of the discharge duct is connected to a second tank and the second tank has a tank overflow for the wire water, the tank overflow forming the discharge duct discharge end overflow.

7. The apparatus of claim 1 wherein the discharge end of the discharge duct is arranged to lead inside a second tank, the discharge end of the discharge duct forming the overflow and the overflow surface, and the second tank opens to the free air space, and wherein the second tank has a separate overflow, and wherein the second tank has a duct leading to a pump and from the pump to the deaeration tank, and that said duct allows wire water to be pumped into the deaeration tank.

8. The apparatus of claim 1 wherein the first branch duct is connected to a suction side of a headbox feed pump, and from the headbox feed pump to communicate with the headbox of the paper machine.

9. The apparatus of claim 8 wherein the discharge duct is connected to a second branch duct, the second branch duct being connected to a source of virgin stock so that virgin stock can be added to wire water from the discharge duct and the second branch duct being connected to a suction side of a second pump and the second pump connects to a centrifugal cleaning plant and the centrifugal cleaning plant connects to the first branch duct which communicates with the headbox through the headbox feed pump.

10. The apparatus of claim 1 wherein the discharge duct has a branch duct which communicates with the headbox at a plurality of different locations in the width direction of the headbox in order to allow dilution of the stock passing to the headbox.

11. The apparatus of claim 1 further comprising a cyclone-shaped device in which a centrifugal field is produced, the cyclone-shaped device being positioned in the inlet duct between the at least one source of wire water and the deaeration tank, to separate air in the form of bubbles from wire water.

12. The apparatus of claim 11 further comprising an air separation duct connected to the cyclone-shaped device, the air separation duct for containing air being separated from the inlet duct.

13. The apparatus of claim 12 wherein the overflow surface of the overflow of the discharge duct is located 5–10 meters below the defined wire water surface within the deaeration tank.

14. The apparatus of claim 1 wherein the first branch duct is in communication with the headbox through a pump and a separator.

15. A method of deaerating wire water and passing the deaerated wire water to a headbox with reduced pressure variation the method comprising the steps of:

collecting wire water from at least one source of wire water and conducting the wire water to a deaeration tank on which a vacuum is pulled, the wire water defining a surface within the deaeration tank;

draining wire water from the deaeration tank from below the wire water surface in the deaeration tank through a discharge duct;

maintaining an outlet of the discharge duct at a constant pressure with an overflow, the overflow defining a surface which is below the wire water surface within the deaeration tank; and conducting a portion of the wire water draining through the discharge duct by a branch of said discharge duct to communicate with the headbox.

16. The method of claim 15 wherein the overflow defines a surface which is 5 to 10 meters below the wire water surface within the deaeration tank.

17. The method of claim 15 wherein a pump draws the portion of the wire water which is conducted to the head box from the discharge duct, and also draws stock having a higher fiber content than the wire water, so that the portion of the wire water is mixed with the stock having a higher fiber content and communicated to the head box.

18. The method of claim 15 wherein a portion of the wire water which is drained from the deaeration tank through the discharge duct is lead through a wall of a stock and/or wire water tank, the discharge duct opening upwardly inside the tank, and wherein the tank has an opening so as to form a free air space.

19. The method of claim 15 wherein the discharge duct has an end which forms the outlet of the duct and the overflow.

20. The method of claim 15 wherein the end of the discharge duct is connected to a second tank and wherein the second tank is arranged to create the overflow and the defined overflow surface.

21. The method of claim 15 wherein the discharge duct is arranged to lead inside a second tank, the discharge end of the discharge duct forming the overflow and the overflow surface, the second tank opening to the free air space and further comprising the step of pumping water from the second tank to the deaeration tank.

22. The method of claim 15 further comprising the step of passing wire water flowing through the inlet duct through a cyclone and separating air from wire water flowing through the inlet duct.

23. The method of claim 15 wherein the portion of the wire water draining through the discharge duct by the branch of said discharge duct communicates with the headbox through a pump and a separator.

* * * * *